United States Patent [19]

Bowes, Jr.

[11] Patent Number: 4,891,893

[45] Date of Patent: Jan. 9, 1990

[54] DREDGE CUTTERHEAD TOOTH ASSEMBLY

[75] Inventor: Stephen M. Bowes, Jr., Jacksonville, Fla.

[73] Assignee: LVI Group, Inc., New York, N.Y.

[21] Appl. No.: 345,951

[22] Filed: Apr. 28, 1989

[51] Int. Cl.[4] ..... E02F 3/92

[52] U.S. Cl. ..... 37/67; 37/142 R; 37/142 A; 299/90; 299/91; 403/355; 403/359

[58] Field of Search ..... 37/142 R, 142 A, 67; 403/355, 357, 359; 299/87, 88, 89, 90, 91, 92

[56] References Cited

U.S. PATENT DOCUMENTS

| | | | |
|---|---|---|---|
| D. 244,597 | 6/1977 | Bowes, Jr. | D15/29 |
| D. 244,683 | 6/1977 | Bowes, Jr. | D15/29 |
| 1,205,969 | 11/1916 | Brinton | 37/142 R |
| 2,233,943 | 3/1941 | Gaylord | 37/67 |
| 2,427,651 | 9/1947 | Baer | 37/142 R |
| 2,483,032 | 9/1949 | Baer | 37/142 R |
| 2,657,482 | 11/1953 | Launder et al. | 37/142 R |
| 2,846,790 | 8/1958 | Davis et al. | 37/142 R |
| 2,870,667 | 1/1959 | Murtaugh | 37/142 R X |
| 2,919,506 | 1/1960 | Larsen | 37/142 R |
| 2,982,035 | 5/1961 | Stephenson | 37/142 R |
| 2,984,028 | 5/1961 | Renner et al. | 37/142 R |
| 2,990,634 | 7/1961 | Eyolfson | 37/142 R |
| 2,994,141 | 8/1961 | Stephenson | 37/142 R |
| 3,012,346 | 12/1961 | Larsen | 37/142 R |
| 3,079,710 | 3/1963 | Larsen et al. | 37/142 R |
| 3,117,386 | 1/1964 | Ferwerda | 37/142 R |
| 3,121,289 | 2/1964 | Eyolfson | 37/142 R |
| 3,126,654 | 3/1964 | Eyolfson et al. | 37/142 R |
| 3,520,224 | 7/1970 | Hensley et al. | 411/512 |
| 3,526,049 | 9/1970 | Nichols | 37/142 A |
| 3,708,895 | 1/1973 | Griffith et al. | 37/142 A |
| 3,808,716 | 5/1974 | Verbeek | 37/67 |
| 4,231,173 | 11/1980 | Davis | 37/142 R |
| 4,320,925 | 3/1982 | Bowes, Jr. | 299/90 |
| 4,428,131 | 1/1984 | Hahn | 37/142 R |
| 4,744,158 | 5/1988 | Berchem et al. | 37/142 R |

OTHER PUBLICATIONS

Amoco advertisement from *Roads and Streets*, p. 70, Oct. 1958.

*Super Helix Cutter*, (multiple pages), Florida Machine & Foundry, 1983.

*Super Helix Cutter*, (single sheet), Florida Machine & Foundry, 1983.

*Bosta Cutter Systems for Soft and Hard Soils*, (6 pages), date unknown.

*Primary Examiner*—Dennis L. Taylor
*Assistant Examiner*—J. Russell McBee
*Attorney, Agent, or Firm*—Arthur G. Yeager; Earl L. Tyner

[57] ABSTRACT

Tooth assembly for a dredge cutterhead, the assembly including a universal male adapter edge for attachment to the cutterhead, a female detachable tooth, a key for locking the tooth to the adapter edge, and a key retainer for locking the key in place.

43 Claims, 5 Drawing Sheets

DREDGE CUTTERHEAD TOOTH ASSEMBLY

BACKGROUND OF THE INVENTION

Dredge cutterheads are generally conical with a multiplicity of hard rock cutting teeth or replaceable edges projecting outwardly from helical support vanes or blades disposed about the conical surface of the cutterhead. The cutterhead normally has a hub which fits around a shaft that provides the torque for turning the cutterhead in its operation of dredging the bottom of waterways. The cutterhead encounters all kinds of material, including rock, which must be removed.

For the purpose of digging in rocky ground the cutterhead is fitted with teeth of high hardness and high impact properties. for the purpose of digging in soft to medium-soft ground the cutterhead is provided with edges of moderate hardness welded to the leading edge of the cutterhead blades. The service life of such welded edges is not as long as that of the hard teeth of the rock cutterhead. The hard teeth extend radially a substantial distance ahead of the blade and do not perform efficiently in the soft-to-medium earth. Accordingly, it is highly desirable to provide a cutterhead employing teeth of high hardness and wear resistance arranged in such a manner as to be efficient for digging in soft-to-medium soils and also to provide the advantages of an easily replaceable forward edge.

The most common variety of replaceable tooth for a dredge cutterhead embodies a pyramidal shape which is attached by an adapter to the cutterhead blade in a manner such that the point of the pyramid is directed at the surface which is to be cut and the longitudinal axis of the tooth, generally passes through the centroid of the cutter blade section and is generally at an angle with respect to the profile plane of the cutterhead from the point of the pyramidal tooth so as to provide an efficient transmission of power to the tooth with a minimum of breaking force.

Replaceable edge cutterheads have been known in the prior art for use in soft-to-medium soils. Such cutterheads have the same basic structure of a conical or semi-spherical shape of helical blades or vanes, but they do not have individual teeth attached thereto or in rock cutterheads. The forward portions of the blades are covered with 2 or 3 large hardened, serrated sections welded end-to-end along the forward portion of the blade to provide an edge which, when worn, can be replaced by new edge sections rather than replacing the entire cutterhead. Wear of the cutting edge is fast and it is important to provide some method of renewing the cutting edge relatively quickly so as to be able to finish a job in a reasonable time and not incur the devastating expenses of delays. Accordingly, it has been important to find a means of making a cutterhead that can perform its dredging tasks properly, efficiently, and with a minimum of delays. Generally, it is believed that this end can be achieved by employing a cutterhead with replaceable teeth attached to the cutter blades in such a fashion as to dig through soft-to-medium soils with a minimum of power usage, a minimum of breakage and wear of the teeth, and a minimum of delays to replace broken or worn parts.

It is an object of this invention to provide an improved dredge cutterhead tooth assembly with a novel locking system. It is another object of this invention to provide an improved dredge cutterhead tooth assembly which will dig in soft-to-medium soils with less power usage and less wear of the cutterhead and its component parts than has been the case with previous systems. It is still another object to provide such a tooth assembly that is universal in that a single shape can be affixed to any location on the cutterhead rather than have a plurality of unique shapes, each being suitable for only one location. It is still another object to provide a tooth assembly system which will form a protective leading helical edge on the blades of a cutterhead. Other objects will become apparent from the more detailed description which follows.

BRIEF SUMMARY OF THE INVENTION

This invention relates to a dredge cutterhead having a replaceable tooth assembly attached to helical blades of the cutterhead, the tooth assembly comprising a male adapter edge designed to be welded to the leading edge of said blades of said cutterhead, a female tooth designed to interfit with said adapter, a key to lock said tooth to said adapter and key retainer means to hold said key in place; said adapter edge being an elongated member with a longitudinal axis extending from a rearward base through a wedge-shaped forward protrusion to a lateral semicylindrical nose, a pair of arms extending laterally outward from opposite sides of said base and shaped to lie above said leading edge of any one of said blades, a half keyway slot passageway extending laterally through said adapter and a recess with an open end positioned medially in said keyway slot and a closed end internally of said adapter and adapted to receive said key retainer means; said tooth being an elongated member with a longitudinal axis coinciding with said longitudinal axis of said adapter edge, a forward cutting edge positioned laterally with respect to said axis, an internal recess adapted to mate with the said protrusion of said adapter, and a lateral half keyway slot passageway extending through said tooth and aligned with said half keyway slot passageway of said adapter edge such that both said half slots, when aligned, produce a full slot to seat said key; said key being an elongated pin having a longitudinal axis and being of such shape in internal cross section as to snugly fit into said full slot, and having on one elongated side parallel to said axis a recess with smoothly tapering edges connecting the bottom of said recess with said one side which engages said slot; and said key retainer means including a compressible member shaped to fit into said recess with an upper surface protruding slightly into said keyway slot, and being shaped with a smoothly tapering protrusion to interfit with said recess in the surface of said key.

In specific and preferred embodiments of the invention the adapter edge is a universal component in that the identical adapter edge is used at every tooth location on the cutterhead and attached in such a direction that each tooth will have the same pitch as every other tooth and the cutting edge of every tooth lies in a single semisphere.

In other preferred embodiments, the key is a generally rectangular elongated rod, and the key retainer means is a compressible mass of an elastomeric material having a corrugated strip of metal bonded thereto to interfit with a corrugated surface of the key. In still another preferred embodiment the teeth on alternate blades of the cutterhead are spaced along the blade so as not to track with the corresponding teeth on the next adjacent blades.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The features and advantages of the tooth assembly of this invention can best be understood by reference to the attached drawings.

Figure 1:
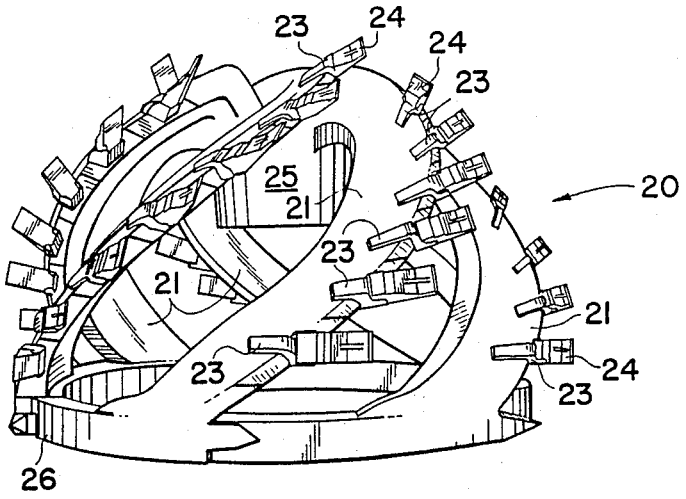
FIG. 1 is a schematic view of a front elevational view of a dredge cutterhead upon which the tooth assembly of this invention might be mounted.

In FIG. 1 there is shown a special dredge cutterhead 20 which is generally semispherical in shape and having several, normally 6, helical blades 21 which extend from a central hub 25 at the forward end of the cutterhead 20 to an outer ring 26 at the rear of the cutterhead 20. Mounted on each blade 21 are a plurality of universal adapter edges 23, normally affixed, by welding, and which, in turn, form seats for teeth 24. Each tooth 24 is pointed in the general direction of rotation of cutterhead 20 so that teeth 24 will bite into the solid material at the bottom of the waterway being dredged in much the same way that a drill bit cuts a hole in the material being drilled. Teeth 24 may be placed at any selected pitch angle so as to be used most efficiently for the various tasks to be undertaken. Generally, the pitch angle is an angle of attack of the teeth which can be varied to suit the type of soft to medium clay material being dredged. The adapter edge 23 is designed in such a way that the rearward base 30 of adapter edge 23 can be attached (as by welding) to the helical forward or leading edge 55 of the blade 21. Arms 54 extend laterally of adapter edge 23 one-half the distance to the next adapter edge 23 along the helical leading edge 55 to form a substantially continuous protective edge between adjacent adapters to receive the abrasive forces of the dredging operation rather than the blade 21 itself. This permits replacement of adapter edges 23 when worn rather than a replacement of the entire cutterhead. Adapter edges 23 of this invention are universal in that a single adapter edge 23 may be attached anywhere on any of the several blades 21 and yet cause the teeth 24 to be set at a selected pitch. Arms 54 function as spacers in that by being butted against the adjacent adapter edges 23 the teeth 24 attached to those adapter edges 23 will be properly spaced from each other. Preferably the locations of teeth 24 on one blade 21 are staggered with respect to the locations of teeth 24 on the next adjacent blade 21 so that corresponding teeth 24 on one blade will not dig in exactly the same path as those on the next adjacent blade. The length of arms 54 is useful in staggering the teeth locations to the same amount over the entire cutterhead.

Figure 2:
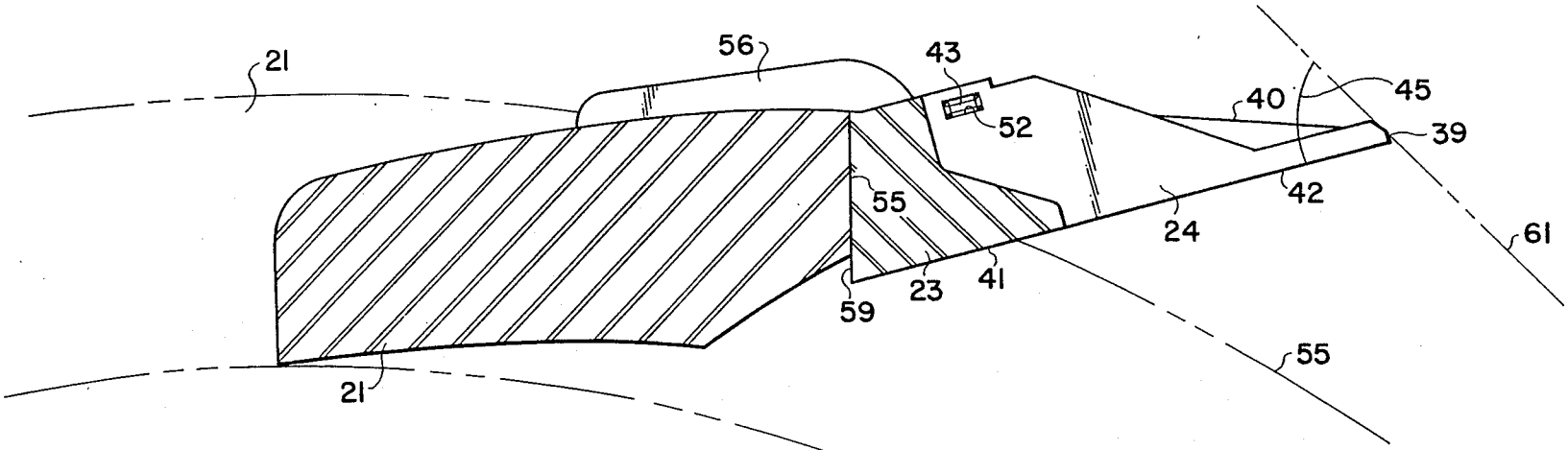
FIG. 2 is a partial cross sectional view showing how the tooth assembly may be mounted on a cutterhead.
Figure 3:
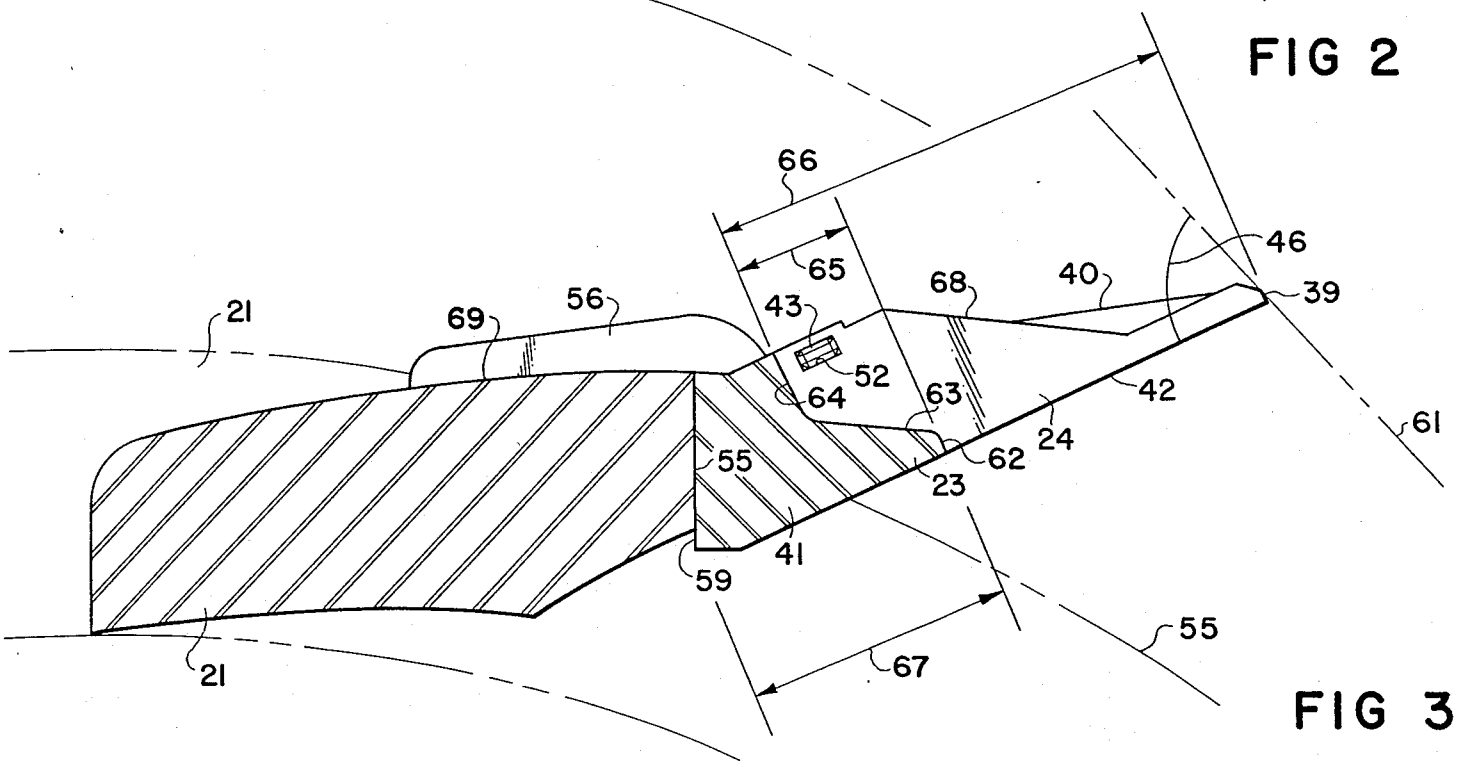
FIG. 3 is a partial cross sectional view similar to that of FIG. 2 except to show a different pitch of the tooth assembly.

FIGS. 2 and 3 show two teeth assemblies of this invention with different pitch angles (45 on FIG. 2) and (46 on FIG. 3).

Figure 4:
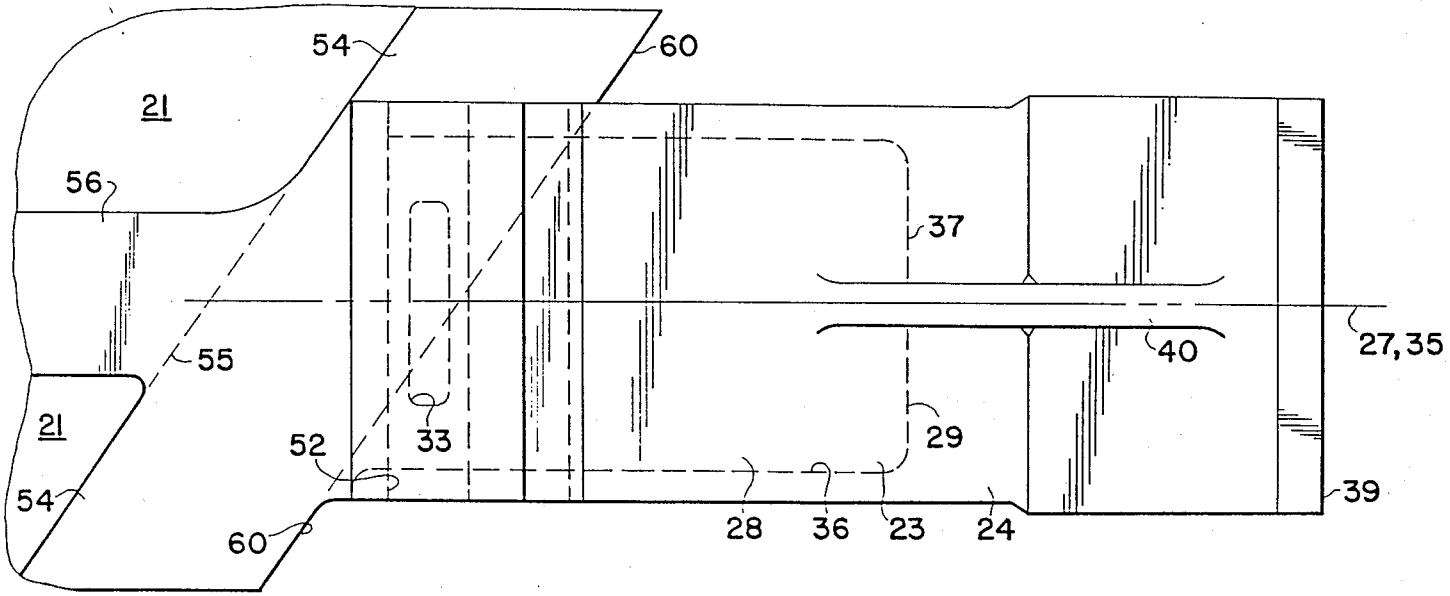
FIG. 4 is a top plan view of the tooth assembly of this invention.
Figure 5:
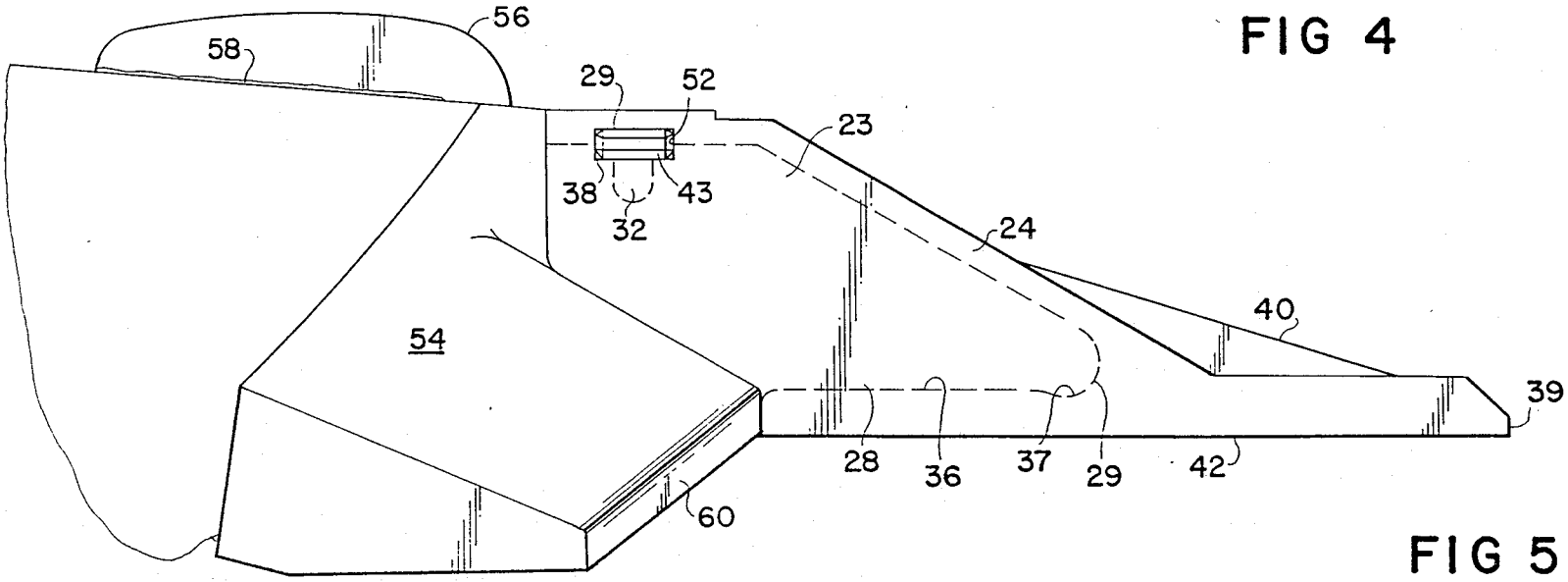
FIG. 5 is a side elevational view of the tooth assembly of FIG. 4.
Figure 6:
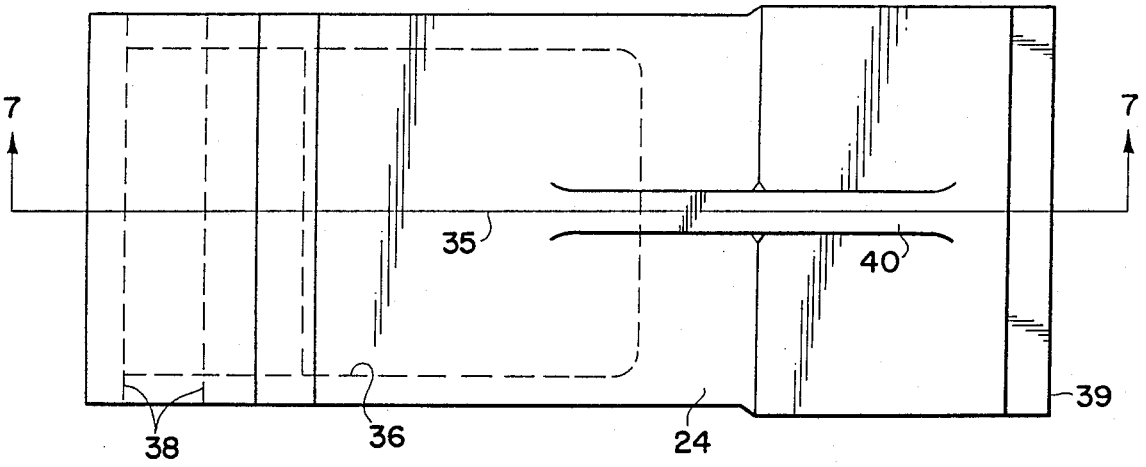
FIG. 6 is a top plan view of the tooth member of this invention.
Figure 7:
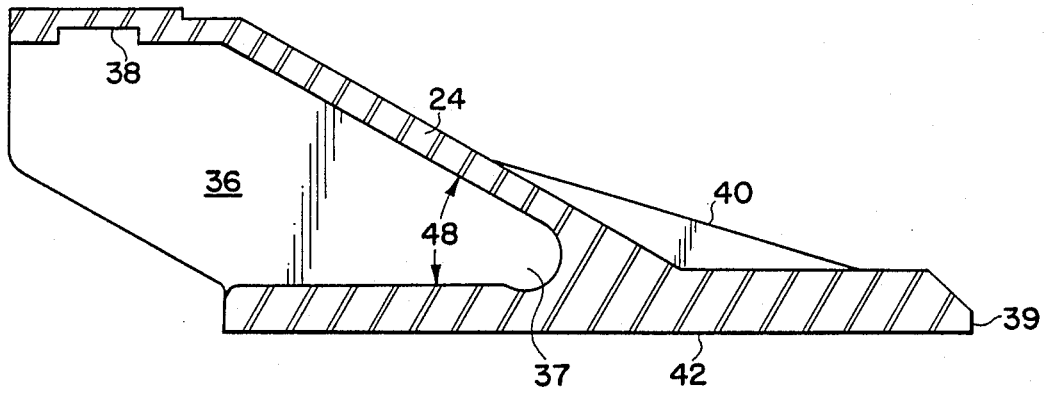
FIG. 7 is a cross sectional view taken at 7—7 of FIG. 6.
Figure 8:
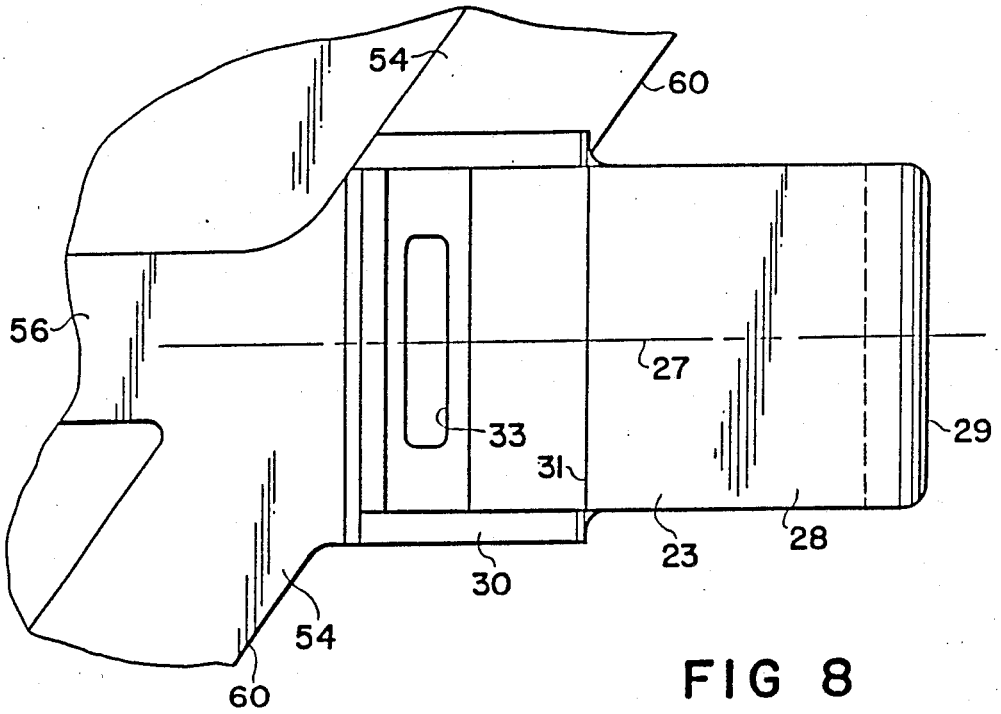
FIG. 8 is a top plan view of the adapter edge member of this invention.
Figure 9:
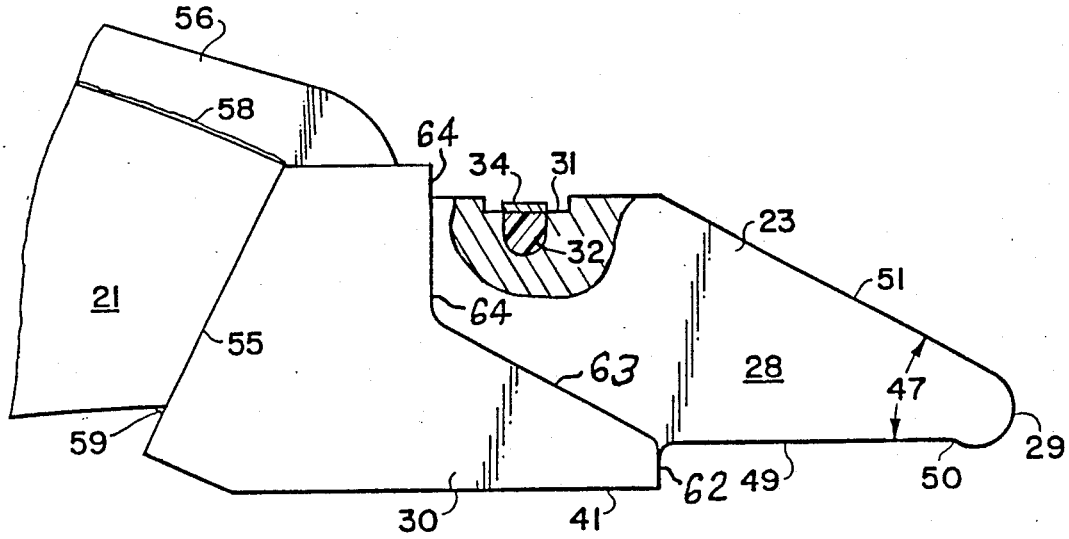
FIG. 9 is a side elevational view, partly in cross section, of the adapter edge member of FIG. 8.

In FIGS. 4–9 there are illustrated views of the combination of tooth 24 and adapter 23 and of each separate member. Adapter edge 23 as seen in FIGS. 8 and 9, has a rearward base 30 which is welded to the forward edge 55 of a blade 21. Arms 54 extend laterally along forward edge 55 half way to the next adapter edge 23 and are welded to blade 21 to form a new forward edge 60 which takes all the wear rather than blade edge 55. There also is a rearward extending reinforcing rib 56 which is an integral part of adapter edge 23 and is welded to blade 21. Adapter 23 has a wedge-shaped forward protrusion 28 and tooth 24 has a wedge-shaped internal recess 36. These two members fit together in a male-female relationship when joined as shown in FIGS. 4 and 5. The forward end of protrusion 28 is formed into a semi-cylindrical lug 29 positioned laterally with respect to longitudinal axis 27 of adapter 23. The shape of rearward base portion 30 is not critical, but generally is made to provide an easy and accurate positioning on the blade 21. A half key slot 31 extends laterally across adapter 23 near the rearward base 30. Generally, in the middle of half slot 31 is the key retainer recess 33 into which is placed key retainer 32 having a smooth protrusion, e.g., a corrugated strip 34 attached to its upper surface. The wedge angle 47 of the wedge-shaped protrusion 28 preferably is about 30°, although it may broadly be any angle in the range of about 20° to about 45°. Adapter base 30 is welded to blade 21 at weld joint 55 and also along reinforcing rib 56 to produce weld joint 58. Once in place, tooth 24 may be assembled thereto or removed for replacement with no concern over the desired pitch.

Tooth 24, as seen in FIGS. 6 and 7, has female features to interfit with the male features of adapter 23. Internal recess 36 is wedge-shaped to receive protrusion 28 of adapter 23, including a semi-cylindrical portion 37 to receive lug 29 of adapter 23. At the forward end of tooth 24 is the cutting edge 39 generally perpendicular to axis 35. Leading face 42 of tooth 24 is the face which, along with cutting edge 39 first contacts the substance being dredged is planar, and is coplanar with face 41 of adapter 23. Tooth 24 also preferably has a reinforcing rib 40 to support face 42 and cutting edge 39 against the resistance forces tending to break tooth 24. At the rearward portion of tooth 24 there is a half key slot 38 which is a mirror image of half key slot 31 of adapter 23. When adapter 23 and tooth 24 are assembled together, slot 31 and slot 38 are aligned to form a rectangular base extending laterally through tooth 24 and adapter 23. In some embodiments it may be preferred that half key slots 31 and 38 are not precisely aligned, but rather are misaligned such that when key 43 is tapped into slots 31 and 38, it will urge tooth recess 36 toward fully closing over protrusion 28. The exact dimensions of protrusion 28, lug 29, recess 36 and recess 37 are not critical but it is preferred that there be about 1/32 inch of tolerance between mating portions to permit a slight wearing to take place before the two portions reach a final fit. The shaping of lug 29 is such that the semi-cylindrical surface is actually present over 180° around lug 29 to provide cooperating shoulders and there is a very short portion at 50 (FIG. 9) where lug 29 joins the forward surface 49 of adapter 23 that is relieved, i.e., parallel to rearward flat surface 51. This provides a locking feature, with the key in place, to prevent tooth 24 from being removed axially parallel to surface 49 of adapter 23, except by a slight clockwise force on the tooth after removal of the key or pin 43. At assembly tooth 24 can be positioned onto adapter 23 with recess 37 having a sufficient clearance to receive lug 29 and then being locked in position by the insertion of pin 43.

Figure 10:
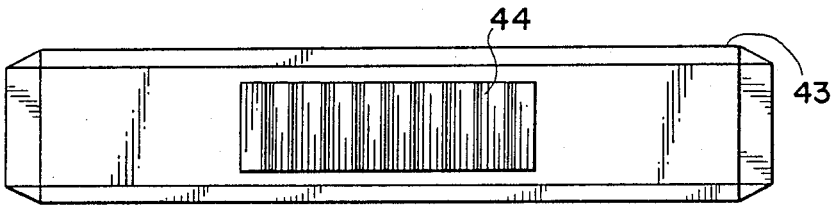
FIG. 10 is a bottom plan view of the key of this invention.
Figure 11:
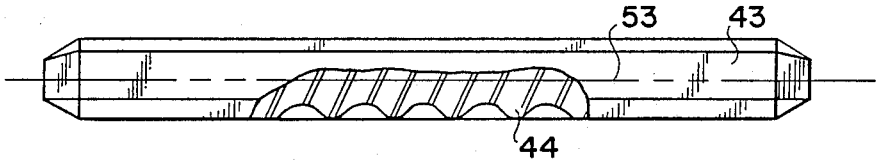
FIG. 11 is a front elevational view, partly in cross section of the key of FIG. 10.
Figure 12:
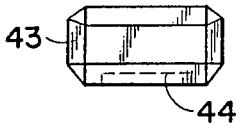
FIG. 12 is an end elevational view of the key of FIGS. 10 and 11.

Key 43 is a pin or rod which fits snugly into the keyway slot 52 formed by the joining of half slot 31 to half slot 38. Key 43 is shown in FIGS. 10–12 as a rectangular rod, beveled or rounded on all corners to provide a facility for inserting or removing key 43 from keyway 52. The lower surface of key 43 is corrugated into a series of alternating ridges and grooves running generally perpendicular to the lengthwise axis 53 of key 43. The exact shape of the ridges and grooves is not critical and may be sinusoidal as shown, or may be more rectangular in shape as in splines, or rifling, so long as they match those on the key retainer discussed below. Key 43 is simply tapped into keyway 52 from either end after adapter 23 and tooth 24 are joined. Preferably key 43 is hardened steel or other metal.

Key retainer 32 is a block of compressible material, such as an elastomer, e.g., rubber, plastic, or the like, with a strip of corrugations 44 as its upper surface. Preferably, strip 44 is a rigid material such as metal, bonded to the body of retainer 32 with strip 34 having corrugations to mate with corrugations 44 of key 43. Key retainer 32 is compressible such that when in place in slot 33 in adapter 23, key 43 may be tapped into place while compressing key retainer 32, following which, key retainer 32 will expand to its original size with corrugated strip 34 mating with corrugations 44. It may be seen that this mating action will prevent key 43 from falling out of keyway 52, which effectively locks adapter 23 to tooth 24. Other configurations or designs may be used to lock key retainer 32 to key 43. For example, key 43 may have a simple recess in place of corrugated surface 44, while key retainer may be a button protrusion device which is spring biased to urge it upward against key 43. Almost any smoothly tapering shapes which interfit in a male/female joint may be employed so long as retainer 32 is compressible to permit key 43 to be placed in its keyway slot, with retainer then expanding to lock itself against key 43.

There are no critical external dimensions of tooth 24. For example, cutting edge 39 may be any reasonable length, the longer providing longer wear life of the tooth. Preferably, the cutting edge 39 may be from about 3 to 6 inches in width for a cutterhead that is about 7–8 feet in diameter.

One of the most important features of the tooth assembly of this invention is the design of the mating surfaces of adapter 23 and tooth 24. It is important to make the length of the tooth assembly 23 and 24 as short as possible and yet be long enough with sufficient wear material to dig into the earth in its dredging task. The design of the seating surfaces 62, 63, and 64 provides the necessary secure load bearing surfaces between tooth 24 and adapter 23 and at the same time provides the "short coupling" feature, by utilizing the distance 65 between surface 64 and the forward base 62 of tooth 24 to form the protective edge of the blades. The two surfaces 62 and 64 are generally perpendicular to face 42. Angular surfaces 63 and 68 are generally parallel to each other. By reason of the fact that surface 62 is forward of surface 64 a significant distance 65 adapter arms can be built as lateral extensions of surface 62 to provide the adapter edge 60 that protects blade 21 while at the same time there is sufficient bearing surfaces at 64 and the surfaces of adapter protrusion 28 to maintain tooth 24 in a stable secure position to absorb the dredging forces on tooth 24. The angular position of surface 63 approaches the top surface 69 of blade 21 to make a smooth juncture between arms 54 and blade 21. Surfaces 63 and 68 are parallel so as to make it possible to place tooth 24 over the wedge-shaped protrusion 28 of adapter 23. This combination of faces and their positions has produced an optimum design for a tooth assembly of a dredge cutterhead having a short coupled tooth which is resistant to tooth breakage.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a rotatable dredge cutterhead having helical blades and teeth attached to these blades, a replaceable tooth assembly comprising a male adapter edge designed to be welded to the leading edge of said blades of said cutterhead, a female tooth designed to interfit with said adapter, a key to lock said tooth to said adapter and key retainer means to hold said key in place; said adapter edge being an elongated member with a longitudinal axis extending from a rearward base through a wedge-shaped forward protrusion to a lateral semicylindrical nose, a pair of arms extending laterally outward from opposite sides of said base and shaped to lie along said leading edge of any one of said blades, a half keyway slot passageway extending laterally through said adapter edge and a recess with an open end positioned medially in said keyway slot and a closed end internally of said adapter edge and adapted to receive said key retainer means; said tooth being an elongated member with a longitudinal axis coinciding with said longitudinal axis of said adapter edge, a forward cutting edge positioned laterally with respect to said axis, an internal recess adapted to mate with the said protrusion of said adapter, and a lateral half keyway slot passageway extending through said tooth and aligned with said half keyway slot passageway of said adapter edge such that both said half slots, when aligned, produce a full slot to seat said key; said key being an elongated pin having a longitudinal axis and being of such shape in lateral cross section as to snugly fit into said full slot, and having on one elongated side parallel to said axis a recess with smoothly tapering edges connecting the bottom of said recess with said one side which engages said slot; and said key retainer means including a compressible member shaped to fit into said recess with an upper surface protruding slightly into said keyway slot and being shaped with a smoothly tapering protrusion to interfit with said recess in the surface of said key.

2. The assembly of claim 1 wherein said key is an elongated metal rod.

3. The assembly of claim 1 wherein said full slot is rectangular in lateral cross section.

4. The assembly of claim 1 wherein one elongated side of said key has a corrugated shape of alternating ridges and grooves generally perpendicular to the lengthwise axis of said key and wherein said key retainer is a solid block of elastomeric material bonded to a corrugated strip of metal shaped to interfit with said elongated side of said key.

5. The assembly of claim 4 wherein said solid block is cylindrical in shape with its lengthwise axis parallel to said lengthwise axis of said key.

6. The assembly of claim 1 wherein said keyway half slots in said adapter edge and in said tooth are located adjacent said rearward base of said adapter edge.

7. The assembly of claim 1 wherein said assembly has a planar leading face extending from said tooth cutting edge to said rearward base of said adapter edge.

8. The assembly of claim 7 wherein said adapter edge and its arms are shaped so as to permit attachment to the leading edge of a blade at any selected pitch angle with respect to said leading face.

9. The assembly of claim 1 wherein the lateral cross sections of said adapter edge protrusion and of said tooth internal recess are generally rectangular and substantially identical with each other.

10. The assembly of claim 1 wherein said recess in said tooth is slightly larger than the corresponding mating portions of said protrusion in said adapter edge.

11. The assembly of claim 10 wherein the actual dimensions of mating parts of said adapter edge and said tooth differ by not more than about 0.03 inch.

12. The assembly of claim 1 wherein said arms are of a length which is substantially equal to one-half of the spacing between adjacent teeth measured along the leading edge of the blade to which said teeth are attached.

13. The assembly of claim 1 wherein said half keyway slots are misaligned sufficiently that when said key is inserted therein it exerts a force urging said tooth toward said rearward base of said adapter edge.

14. The assembly of claim 1 wherein each said adapter edge includes, in addition to said arms a reinforcing rib extending axially rearwardly of said rearward base along the surface of said blade.

15. The assembly of claim 1 wherein said adapter edge is welded to said cutterhead blade.

16. The assembly of claim 1 wherein said key retainer includes an upper button-like protrusion which interfits in a male-female joint into said recess in said key.

17. The assembly of claim 16 wherein said key retainer includes a spring-biased protrusion.

18. In a rotatable dredge cutterhead having helical blades and a plurality of spaced and replaceable tooth assemblies, each said tooth assembly comprising a male adapter for welding respectively to the leading edge of the blade of the cutterhead, a replaceable female tooth for interfitting with said adapter, a key to lock said tooth to said adapter and a key retainer means to maintain said key in place during locking engagement between said tooth and adapter, said adapter being an elongated member with a longitudinal axis extending from a rearward base through a wedge-shaped forward protrusion, said tooth having an internal recess adapted to mate with said protrusion and a cutting edge, a keyway extending laterally through said adapter and a recess in said adapter positioned generally medially of and communicating with said keyway said key retainer means being disposed in said recess, said tooth having a longitudinal axis coinciding with said longitudinal axis of said adapter, said tooth including a forward cutting edge positioned laterally with respect to said longitudinal axis and an internal recess adapted to mate with said protrusion of said adapter, said tooth further including a keyway extending laterally through said tooth and aligned with said keyway of said adapter such that both said keyways, when aligned, being adapted to receive said key, said key being formed of an elongated pin having a longitudinal axis and being of a shape in lateral cross section as to snugly fit into said keyways, said key having on at least one elongated side parallel to its said longitudinal axis a recess formed therein, said key retainer means including a compressible member having an exposed surface adjacent said one side of said key shaped to generally fit into said recess of said key, said exposed surface protruding slightly into said keyway of said adapter.

19. The assembly of claim 18 wherein said adapter includes a nose adjacent its forward end portion and said tooth includes a forward end portion for accommodating said nose of said adapter, said forward end portions including respective shoulders cooperating to releasably lock said tooth onto said adapter while said key is lockingly disposed within said keyways.

20. The assembly of claim 19 wherein said compressible member provides a locking force onto said key which is generally perpendicular to said longitudinal axes of tooth and adapter to maintain said key in said keyways.

21. The assembly of claim 19 wherein said shoulders are disposed adjacent a bottom of said adapter and said keyways are disposed adjacent a top of said adapter with said top and bottom being generally oppositely disposed.

22. The assembly of claim 19 wherein said adapter includes a pair of arms extending laterally outward from opposite sides of said base and shaped to lie along the leading edge of any one of the blades.

23. The assembly of claim 18 wherein one elongated side of said key includes a corrugated shape of alternating ridges and grooves generally perpendicular to the lengthwise axis of said key, said compressible member being formed of a solid block of elastomeric material bonded to a corrugated strip of metal having at least one ridge shaped to interfit with at least one said groove of said key.

24. The assembly of claim 18 wherein said protrusion includes a lateral semi-cylindrical nose formed as its forward end portion.

25. The assembly of claim 24 wherein the lateral cross sections of said adapter protrusion and of said tooth internal recess are generally rectangular and substantially identical with each other, said tooth internal recess having a semi-cylindrical nose receiving portion generally medially between its ends for releasably locking said nose thereto after positioning said tooth onto said adapter.

26. The assembly of claim 25 wherein said adapter base, arms and rib are welded to the blade of a cutter with the leading edges of each said arm and tooth cutting edges forming a cutter edge of the blade of a cutterhead.

27. The assembly of claim 18 wherein said recess in said tooth is slightly larger than the corresponding mating portions of said protrusion in said adapter to permit wear before providing a bearing fit between said tooth and said adapter.

28. The assembly of claim 27 wherein said tooth includes a plurality of spaced edges adjacent its rearward end portion defining an entryway of said internal recess of said tooth, said spaced edges contacting corresponding surfaces of said base of said adapter to provide a full bearing fit between said tooth and said adapter.

29. The assembly of claim 28 wherein two pair of opposed said spaced edges of said tooth are inclined and are generally parallel to one surface forming said wedge-shaped forward protrusion.

30. The assembly of claim 29 wherein outer surfaces of said tooth are substantially coextensive with the outer surfaces of said base of said adapter.

31. The assembly of claim 30 further comprising a pair of arms extending laterally outwardly from respective opposite sides of and affixed to said adapter, said arms being adapted to be affixed to and forming a part of a leading edge of the blade of the cutterhead.

32. The assembly of claim 31 wherein said arms are of a length which is substantially equal to one-half of the spacing between adjacent teeth measured along a leading edge of the blade to which said teeth are attached.

33. The assembly of claim 32 wherein said cutting edge of said tooth is positioned within a plane which passes through a center of rotation of the cutterhead, said cutting edge having a constant pitch with said plane when said assembly is located at any position on the blade.

34. The assembly of claim 33 wherein said cutting edge of all said teeth on the cutterhead are positioned to form a portion of a sphere and said leading edges of said arms form a portion of a sphere.

35. The assembly of claim 28 two pair of said opposed spaced edges are on opposite sides of said assembly and are generally perpendicular to said longitudinal axis, a first pair of said two pair being at the rearward extremity of said tooth and located on one of said opposite sides, and a second pair of said two pair being spaced generally medially between said first pair and said cutting edge and being located on the other of said opposite sides.

36. The assembly of claim 35 wherein said other of said opposite sides is a planar face of said tooth including said cutting edge.

37. The assembly of claim 35 where the distance between said first pair and said second pair is about one third the length of said tooth.

38. The assembly of claim 18 wherein said keyways in said adapter and tooth are misaligned sufficiently that when said key is inserted therein a force is exerted by said key urging said tooth toward said rearward base of said adapter.

39. The assembly of claim 18 further comprising a pair of laterally extending arms on opposite sides of said base, and a reinforcing rib extending rearwardly of said base along the surface of the blade of the cutterhead, said rib having a longitudinal axis extending substantially parallel to said longitudinal axes of said tooth and adapter.

40. In the assembly of claim 18 wherein said compressible member exerts a locking force on said key in an unaligned direction parallel to said longitudinal axes.

41. In the assembly of claim 40 wherein each said tooth and said adapter include cooperating shoulders which inhibit removal of said tooth from said adapter when said key is disposed in said keyways to lock said tooth onto said adapter.

42. In the assembly of claim 41 wherein said shoulders are disposed generally oppositely with respect to said keyways.

43. In the assembly of claim 41 wherein said shoulders are forwardly disposed adjacent a front portion of said protrusion, said shoulder on said tooth having a relief surface parallel to an inclined surface of said wedge-shaped forward protrusion to permit entry of said tooth shoulder into locking engagement with said adapter shoulder when said key is disposed in said keyways.

* * * * *